US006759592B1

(12) United States Patent
Cai et al.

(10) Patent No.: US 6,759,592 B1
(45) Date of Patent: Jul. 6, 2004

(54) KAOLIN ADDITIVE IN MINERAL INSULATED METAL SHEATHED CABLES

(75) Inventors: Kevin Guangjun Cai, Ontario (CA); Mickael Blamire, Ontario (CA); Robert Stokes, Ontario (CA); Douglas Wilton, Ontario (CA); James Snape, Ontario (CA); Glyn Jones, Ontario (CA); Jeff Babcock, Ontario (CA); Ann Machan, Ontario (CA)

(73) Assignee: Tyco Thermal Control UK Limited, Tyne & Wear (GB)

( * ) Notice: Subject to any disclaimer, the term of this patent is extended or adjusted under 35 U.S.C. 154(b) by 0 days.

(21) Appl. No.: 09/776,676

(22) Filed: Feb. 6, 2001

(51) Int. Cl.[7] ..... H01B 3/10
(52) U.S. Cl. ..... 174/110 A
(58) Field of Search ..... 174/102 R, 102 P, 174/110 A, 116, 118

(56) References Cited

U.S. PATENT DOCUMENTS 3,745,288 A 7/1973 Reimer
4,200,077 A * 4/1980 Kauhl et al. ..... 123/145 A
5,610,378 A 3/1997 DuRocher et al.
6,077,472 A * 6/2000 Kataoka et al. ..... 264/219
6,172,312 B1 1/2001 Maranzano
6,466,123 B1 * 10/2002 Kuzuoka et al. ..... 338/25

FOREIGN PATENT DOCUMENTS

GB 2178606 * 2/1987
WO WO 93/05520 * 3/1993

OTHER PUBLICATIONS

Hawley, "Condensed Chemical Dictionary", 1981, p. 590.*

* cited by examiner

*Primary Examiner*—Chau N. Nguyen
(74) *Attorney, Agent, or Firm*—Akin Gump Strauss et al.; William C. Youngblood

(57) ABSTRACT

Kaolin is added to the insulation (30) in a metal sheathed, mineral-insulated cables of the type used as a power cable, heating cable, or thermocouples where high temperature and an aggressive medium may exist, and which are typically produced by drawing down the cable. The preferred insulation for the invention is MgO. The addition of kaolin decreases moisture seepage into the insulation and consequent drop in insulation resistivity. It also reduces the loss of electrical resistance as temperature increases.

15 Claims, 1 Drawing Sheet

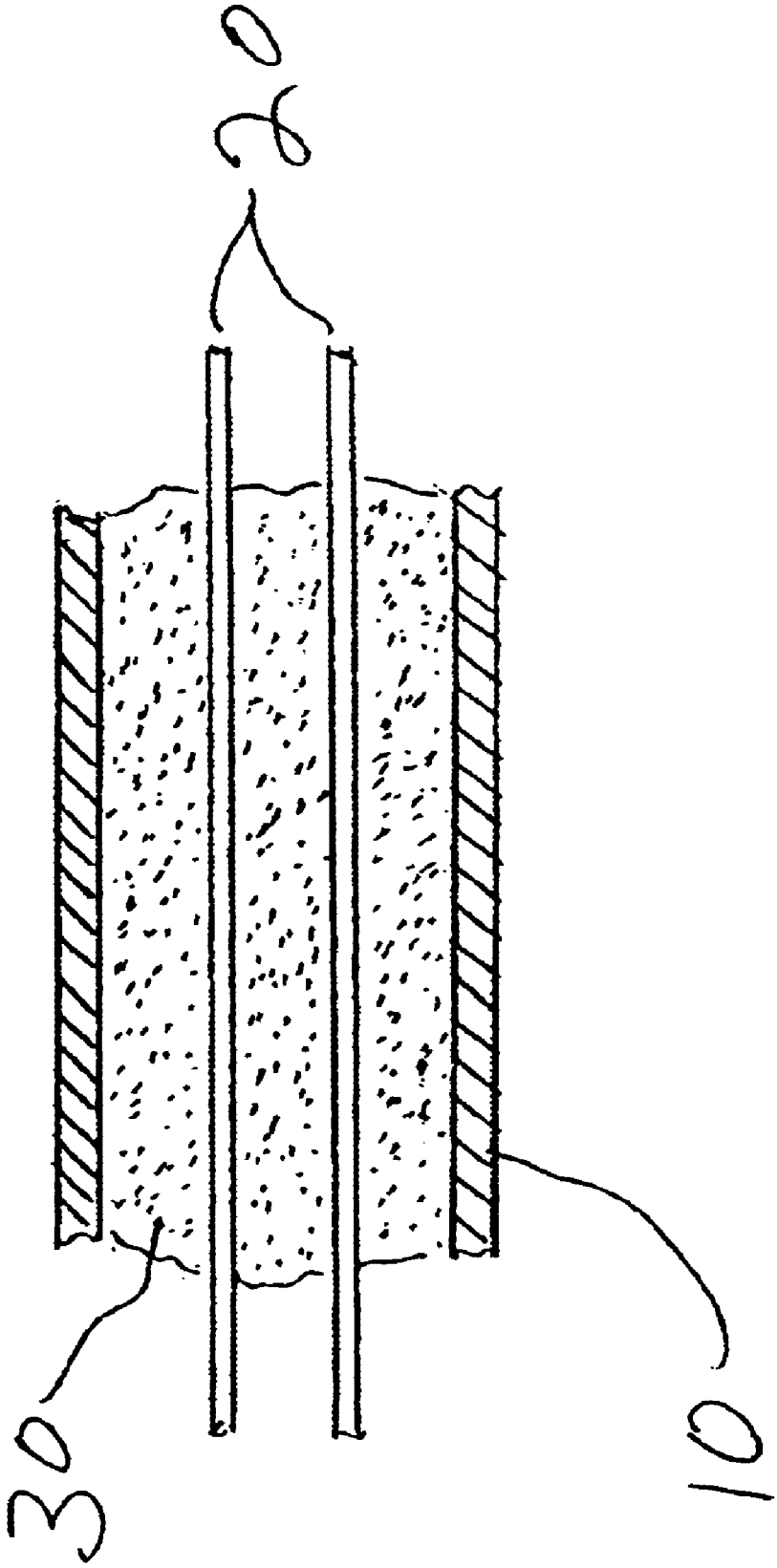
20
30
10

KAOLIN ADDITIVE IN MINERAL INSULATED METAL SHEATHED CABLES

BACKGROUND OF THE INVENTION

1. Field of the Invention

The present invention relates to mineral-insulated cables. Such cables, generally metal sheathed, are intended for electricity transportation, electric heat tracing, and temperature measurement applications.

2. Description of the Related Art

Metal sheathed mineral-insulated cables are used in the fields of electricity transportation (as power cable), electric heat tracing (as heating cable) and temperature measurement (as thermocouples). These cables are used in places where high temperature and an aggressive medium may exist. The materials of the metal sheath and conductors are varied for different applications and different environment.

The metal sheathed mineral-insulated cable has a metallic outer sheath, at least one inner conductor, and a mineral-based insulation which is usually magnesium oxide (MgO). MgO is preferably used as the insulation material for the metal sheathed mineral-insulated cables because it is stable at high temperatures and inert with the sheath and conductor materials. It provides a high electricity resistance and is also economical.

The metal sheathed mineral-insulated cable is produced by first filling a metal tube (which forms the metal sheath) with the conductor or conductors and the MgO insulator, then drawing down to the required size which is determined by the application parameters of the cable.

One problem with conventional metal sheathed mineral-insulated cable is that the insulation is susceptible to absorption of water and consequent decreased resistivity. The MgO insulator is composed of magnesium oxide crystal particle clumps, and between the particles there are always cavities. These cavities connect with each other and form channels. Water (moisture) could seep in through these micro-channels in the insulation and be absorbed on the particle surfaces. Since water is a conductor, such seepage will degrade the electricity resistance of the insulation or even result in the cable failing. And the more water that seeps in, the lower the electricity resistance of the insulation will be.

Another problem with the metal sheathed mineral-insulated cable is that as temperature increases, electrical resistance of the insulation decreases. Because low resistance will lead to high leakage current, degradation of the electricity resistance will affect the performance of the cable.

Different materials and methods have been explored to prevent water seepage into MgO, and increase the insulation resistance at enhanced temperatures. None has been entirely satisfactory.

SUMMARY OF THE INVENTION

Kaolin has been found to give good results.

According to the present invention a metal-sheathed cable with mineral insulation, in particular a cable with MgO insulation, has kaolin added to the insulation to prevent moisture from infiltrating the insulation and decreasing its resistivity. Kaolin also increases the resistivity at high temperatures.

Kaolin is a naturally-existing clay composed mainly of aluminum silicate. Just how kaolin prevents water seepage into MgO is not very clear. One possible mechanism is that, because kaolin is not as hydrophilic as MgO and kaolin powder is finer than MgO, the fine kaolin powder fills the cavities in the MgO, thus preventing water from seeping in. The effect of kaolin on electricity resistance at high temperature is determined by the property of the material itself.

As a general phenomenon, when temperature increases, the resistance of a material decreases. The decreasing behavior is characteristic for each material (indicated by a factor called resistance temperature coefficient). Kaolin has a smaller resistance temperature coefficient, so that its resistivity decreases more slowly as temperature increases than that of MgO, and as a result, kaolin-doped MgO has a higher resistivity at high temperature than pure MgO.

BRIEF DESCRIPTION OF THE DRAWINGS

The FIGURE is a schematic cross-sectional view, showing the metal sheathed mineral insulated cable with kaolin added to the insulation.

DETAILED DESCRIPTION OF THE INVENTION

The drawing FIGURE shows the cable of the present invention which includes a preferably metallic outer cable sheath 10, at least one inner conductor 20 (two are shown in the FIGURE), and a mineral-based insulation 30 which, according to the present invention, includes kaolin.

The insulation 30 should include between 3% and 20% by dry weight of kaolin; more preferably, between 3% and 15% of kaolin; and most preferably between 5% and 10% of kaolin.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A cable comprising an outer metallic sheath, at least one metallic conductor therein, and a powdered filler disposed between the outer sheath and the metallic conductor, wherein the filler comprises a mineral insulation consisting essentially of a mixture of magnesium oxide and kaolin.

2. The cable according to claim 1, wherein the kaolin is present in an amount of about 3% to about 20% by dry weight in the mineral insulation.

3. The cable according to claim 1, wherein the kaolin is present in an amount of about 3% to about 15% by dry weight in the mineral insulation.

4. The cable according to claim 1, wherein the kaolin is present in an amount of about 5% to about 10% by dry weight in the mineral insulation.

5. A method of manufacturing a metal sheathed mineral-insulated cable comprising, filling a metal sheath with at least one metallic conductor and a powdered mineral insulation filler comprising magnesium oxide and kaolin powder; and drawing down the sheath.

6. The method according to claim 5, further comprising mixing the magnesium oxide and the kaolin powders to form the filler before the filling step.

7. A method of reducing a decrease in resistivity of a cable comprising, disposing at least one metallic conductor in a metallic sheath; filling the sheath with a powdered mineral insulation filler comprising a mixture of magnesium oxide and kaolin; and drawing down the sheath.

8. The method according to claim 7, wherein the kaolin is present in an amount of about 3% to about 20% by dry weight in the mineral insulation.

9. The method according to claim 7, wherein the kaolin is present in an amount of about 3% to about 15% by dry weight in the mineral insulation.

10. The method according to claim 7, wherein the kaolin is present in an amount of about 5% to about 10% by dry weight in the mineral insulation.

11. A method of reducing moisture infiltration to a cable comprising, disposing at least one metallic conductor in a metallic sheath; filling the sheath with a powdered mineral insulation filler comprising a mixture of particles of magnesium oxide and kaolin powder, and drawing down the sheath.

12. The method according to claim 11, wherein the kaolin powder is present in an amount of about 3% to about 20% by dry weight in the mineral insulation.

13. The method according to claim 11, wherein the kaolin powder is present in an amount of about 3% to about 15% by dry weight in the mineral insulation.

14. The method according to claim 11, wherein the kaolin powder is present in an amount of about 5% to about 10% by dry weight in the mineral insulation.

15. The method of claim 11, wherein the kaolin powder fills the cavities in the magnesium oxide.

* * * * *